US005915952A

United States Patent [19]

Manning et al.

[11] Patent Number: 5,915,952

[45] Date of Patent: Jun. 29, 1999

[54] METHOD AND APPARATUS FOR CONTROLLING GAS FLOW TO CERAMIC PLAQUE BURNERS OF DIFFERING SIZES

[75] Inventors: John S. Manning; Christopher P. Hollis; James L. Jacobs; Ralph E. Pratt, all of Bowling Green, Ky.

[73] Assignee: Desa International, Bowling Green, Ky.

[21] Appl. No.: 09/100,289

[22] Filed: Jun. 19, 1998

Related U.S. Application Data

[62] Division of application No. 08/861,950, May 22, 1997, Pat. No. 5,795,145.

[51] Int. Cl.[6] ..... F23N 11/44

[52] U.S. Cl. ..... 431/12; 431/280

[58] Field of Search ..... 431/280, 12

*Primary Examiner*—Carroll B. Dority
*Attorney, Agent, or Firm*—Jones, Day, Reavis & Pogue

[57] ABSTRACT

A radiant gas heater includes a first ceramic plaque burner and an adjacent and larger second plaque burner. A valve spindle is movable to establish in series "Low," "Medium" and "High" heat positions by first supplying gas in the vicinity of the first burner, then supplying gas in the vicinity of the second burner while momentarily maintaining the flow of gas to the first burner, next discontinuing the flow of gas to the first burner and finally by reestablishing the flow of gas to the first burner while maintaining the flow of gas to the second burner.

13 Claims, 4 Drawing Sheets

10
12
LOW 10
12
MEDIUM 10
12
HIGH

MEDIUM

HIGH

LOW

LOW

MEDIUM

HIGH

METHOD AND APPARATUS FOR CONTROLLING GAS FLOW TO CERAMIC PLAQUE BURNERS OF DIFFERING SIZES

This application is a division of U.S. patent application Ser. No. 08/861,950, filed May 22, 1997, and now U.S. Pat. No. 5,795,145.

BACKGROUND OF THE INVENTION

Radiant gas heaters with inputs greater than about 10,000 BTU/hour typically use multiple burners having ceramic plaques mounted adjacent to one another in a horizontal fashion within a cabinet. The combustion of the gas and air mixture occurs very near the outer surface of the plaque, which produces radiant heat off of a glowing surface. The user of such a heater may select a heat setting by manually turning a control knob of a gas valve to "Low", "Medium", or "High" heat settings in series which is a logical operating sequence.

For example, individual burners may produce about 6,000 BTU/hour each. An 18,000 BTU/hour heater would have three individual burners. The operating sequence of such a heater would be 6,000 BTU/hour or one burner on "Low"; 12,000 BTU/hour or two burners on "Medium"; 18,000 BTU/hour or three burners on "High". FIGS. 1(*a*)–1(*c*) depict this operation.

The first burner turned "on" at the "Low" setting would be ignited by a pilot. Subsequent burners turned "on" at the "Medium" or "High" settings would be ignited by the adjacent burner. In the previous example, the "Low" setting would correspond to the middle burner; the pilot would be mounted approximately at the lowest plane of this burner. "Medium" and "High" settings would correspond to the left and/or right burners; they would be ignited by the center burner.

The manually operated control valves typically provide distinct notches for engaging the valve in the "Low", "Medium", and "High" settings. Consequently, the user employs a combination of press and turn motions of the control knob to select another heat setting. The rotational movement between settings range from about 40 to 60 degrees; thus, a short but discrete length of time is involved in changing from one setting to another.

Some radiant gas heaters replace two of the individual burners with one larger burner. The primary benefit of such a design is simplification for cost reduction. However, the operating sequence for existing heaters having this burner configuration is less desirable for a user because it is illogical. Using a similar example as before, an 18,000 BTU/hour heater would have two individual burners: one large at 12,000 BTU/hour and one small at 6,000 BTU/hour. The user may select a heat setting by manually turning a control knob of a gas valve, but in this design the operating sequence would be 12,000 BTU/hour or the large burner on "Medium"; 18,000 BTU/hour or both burners on "High"; 6,000 BTU/hour or the small burner on "Low". FIGS. 2(*a*)–2(*c*) depict this operation.

The large burner turned "on" at the first (Medium) setting would be ignited by the pilot. In the second (High) setting, the adjacent small burner would be ignited by the large burner that remains "on". Lastly, the third (Low) setting would result in the large burner turning "off" and the small burner remaining "on". This operating sequence is necessary in order to insure safe ignition characteristics when using current gas valves.

The problem in going from "Low" to "Medium" rather than from "Off" to "Medium" in a heater of the type just described is that if the control knob of the gas valve is rotated slowly, a momentary lapse in supplying gas to an individual burner may occur. Delayed ignition—an undesirable and potentially unsafe condition—may occur when changing the setting from "Low" to "Medium". The "Low" setting would correspond to the small burner being "on"; the "Medium" setting would correspond to the large burner being "on" and the small burner being "off". Delayed ignition may occur if the flame at the small ("Low") burner is extinguished before ignition occurs at the large ("Medium") burner. Thus, the design and construction of current gas valves, specifically relating to the geometry of the interrelated parts that direct the gas flow from the single inlet to the multiple outlets, force the operating sequence for safe operation to be from "Medium" to "High" to "Low", as shown in FIGS. 2(*a*)–2(*c*), thereby resulting in positive ignition characteristics.

SUMMARY OF THE INVENTION

The present invention resides in a configuration of a gas valve for controlling gas flow to ceramic plaque burners of differing sizes in order to achieve progressively higher inputs with safe ignition characteristics in a gas heater. Using the same example as before, an 18,000 BTU/hour heater would have two individual burners: one large at 12,000 BTU/hour and one small at 6,000 BTU/hour. The user may select a heat setting by manually turning a control knob of a gas valve. The operating sequence would be 6,000 BTU/hour or the small burner on "Low"; 12,000 BTU/hour or the large burner on "Medium"; 18,000 BTU/hour or both burners on "High". FIGS. 3(*a*)–3(*c*) depict this operation.

Such a heater design has two distinct advantages. First, the use of one large burner to replace two small burners results in simplification for cost reduction. Second, the operating sequence of "Low" to "Medium" to "High" is logical for users which simplifies operation.

The invention eliminates the delayed ignition when changing the heat input setting. The design and construction of the valve of the present invention, specifically related to the geometry of the interrelated parts that direct the gas flow from the single inlet to the multiple outlets, allow a logical operating sequence with safe operation. Within the valve housing is a truncated cone spindle that is turned by a control knob. The spindle has both a slot and holes for directing the gas flow into the appropriate outlets on the valve housing. The invention resides in the geometric relationship between these spindle features and the valve housing outlets and the method of operating the valve. When the control knob—and concurrently the spindle—is rotated from "Low" to "Medium", the gas flow continues momentarily to the small burner (Low) as it is redirected to the large burner (Medium). This lag in shutting off the gas flow to the small burner allows ignition to be established on the large burner from the small burner before the small burner is turned completely "off".

DESCRIPTION OF A PREFERRED EMBODIMENT

Figure 8:
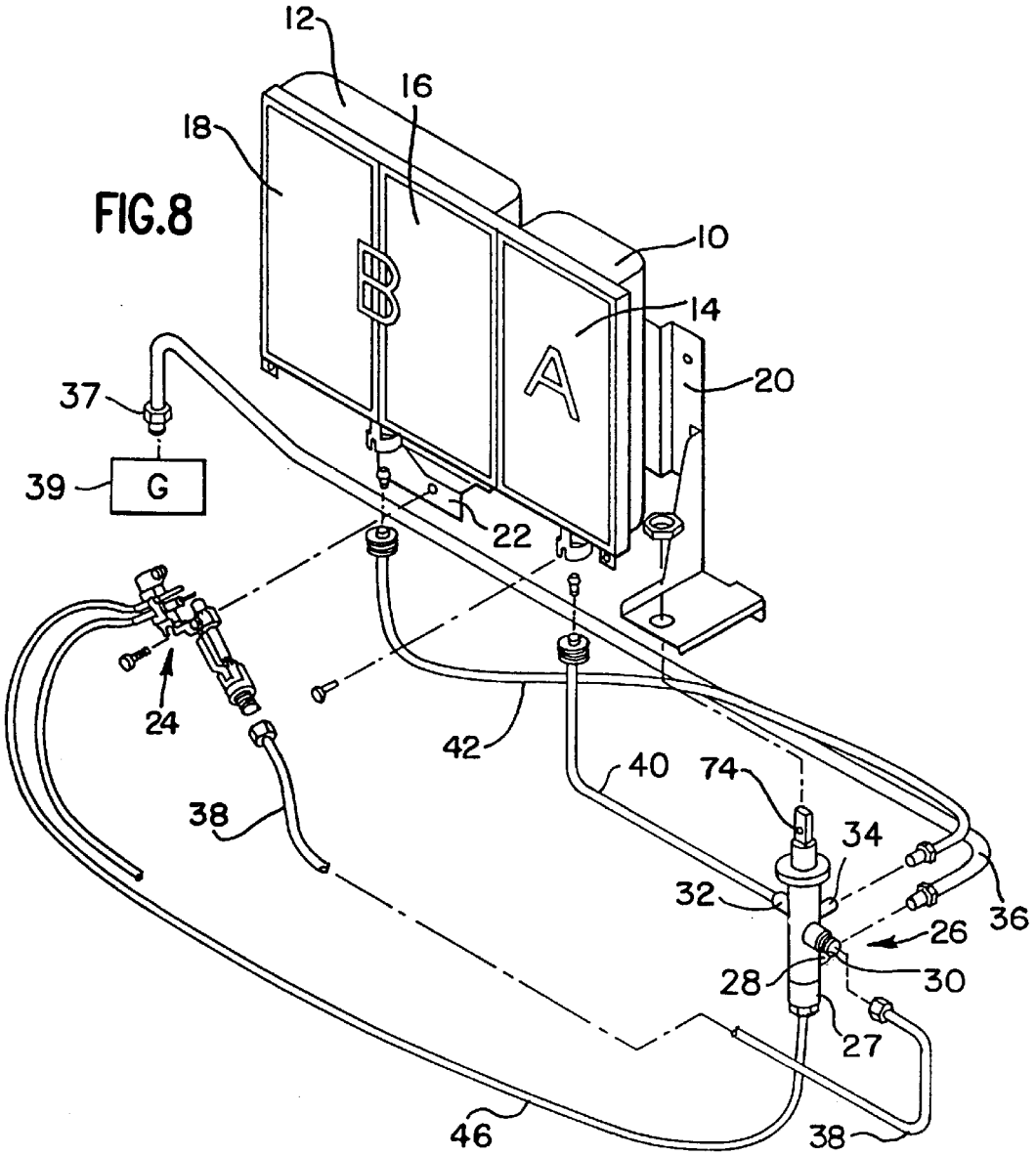
FIG. 8 is a fragmentary, exploded isometric view of a two-plaque burner embodying the present invention.
Figure 9A:
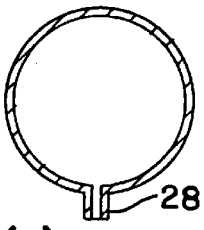
FIGS. 9(*a*)–9(*f*) are sequential schematic views taken along line 9—9 of FIG. 5.
Figure 10A:
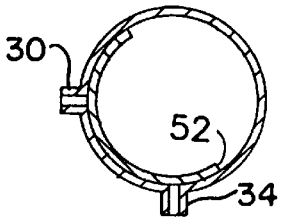
FIGS. 10(*a*)–10(*f*) are sequential schematic views taken along line 10—10 of FIG. 5.
Figure 11A:
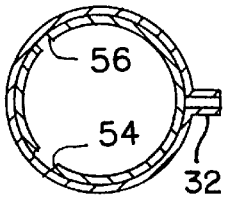
FIGS. 11(*a*)–11(*f*) are sequential schematic views taken along line 11—11 of FIG. 5.
Figure 9B:
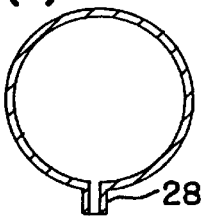
Figure 10B:
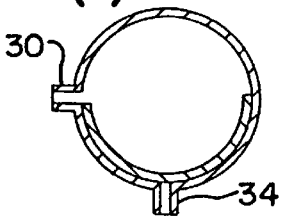
Figure 11B:
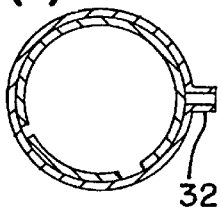
Figure 9C:
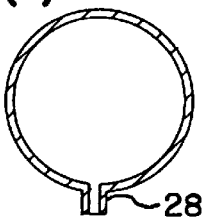
Figure 10C:
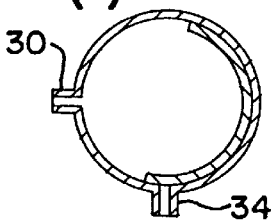
Figure 11C:
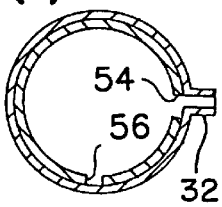
Figure 9D:
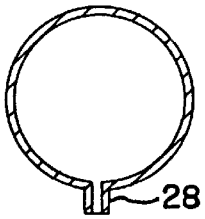
Figure 10D:
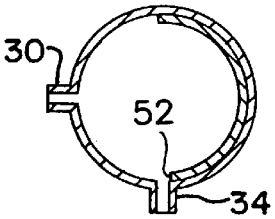
Figure 11D:
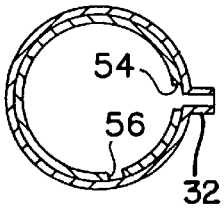
Figure 9E:
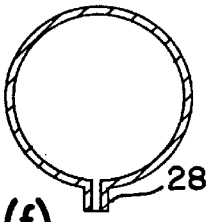
Figure 10E:
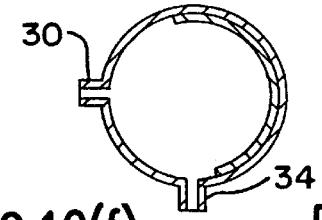
Figure 11E:
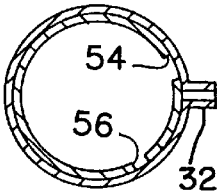
Figure 9F:
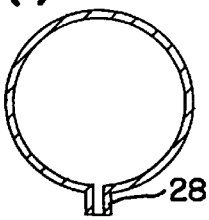
Figure 10F:
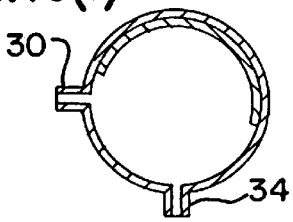
Figure 11F:
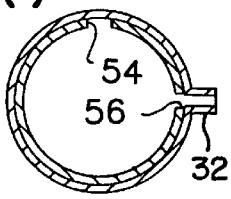

Referring first to FIG. 8, a healer embodying the present invention includes a first burner 10 and a larger burner 12. In the embodiment shown for purposes of illustration, but not by way of limitation, the small burner is in the form of a plaque burner having a rectangular ceramic plaque 14. In the embodiment shown for purposes of illustration, the larger burner 12 includes two ceramic plaques 16 and 18. However, the larger burner may be formed as a single ceramic plaque. A suitable bracket mounts the plaques in substantial co-planar relationship. For example, in the preferred embodiment, the burner 10 has a rating of 6,000 BTU/hour; the larger burner 12 has a rating of 12,000 BTU/hour.

The burner 12 includes a bracket 22 for mounting a pilot light assembly 24; this pilot light assembly is of conventional construction and includes an oxygen depletion sensor. The bracket 22 mounts the pilot light assembly 24 such that the pilot flame will be directed toward the small burner 10.

Referring now to FIGS. 4–6 and 8, the present invention includes a valve, generally designated 26. This valve includes a generally cylindrical housing 27 having an inlet passageway 28. The valve housing 27 includes outlet passageways 30, 32 and 37.

The inlet passageway 28 is in communication with one end of an inlet tube 36 (FIG. 8). It will be understood that the other end of the tube 36 is in communication with a suitable source of gas 39, such as propane or natural gas. The passageway 30 is in communication with one end of a tube 38; the other end of this tube is in communication with the pilot light assembly 24. Outlet passageway 32 is in communication with one end of a tube 40; the other end of this tube communicates with the face of the ceramic plaque 14 of the small burner. Outlet passageway 34 is in communication with one end of a tube 42; the other end of this tube communicates with the faces of the plaques 16 and 18 of the larger burner 12. Valve 26 is also in communication with a thermocouple lead 46 which is in communication with the pilot light assembly. As is known to those skilled in the art, if the oxygen depletion sensor forming part of the pilot light assembly detects a predetermined minimum amount of oxygen in the vicinity of the burners, the thermocouple will be activated for turning off the flow of gas to the burners.

Figures 1A, 1B, 1C, 2A, 2B, 2C, 3A, 3B, 3C:
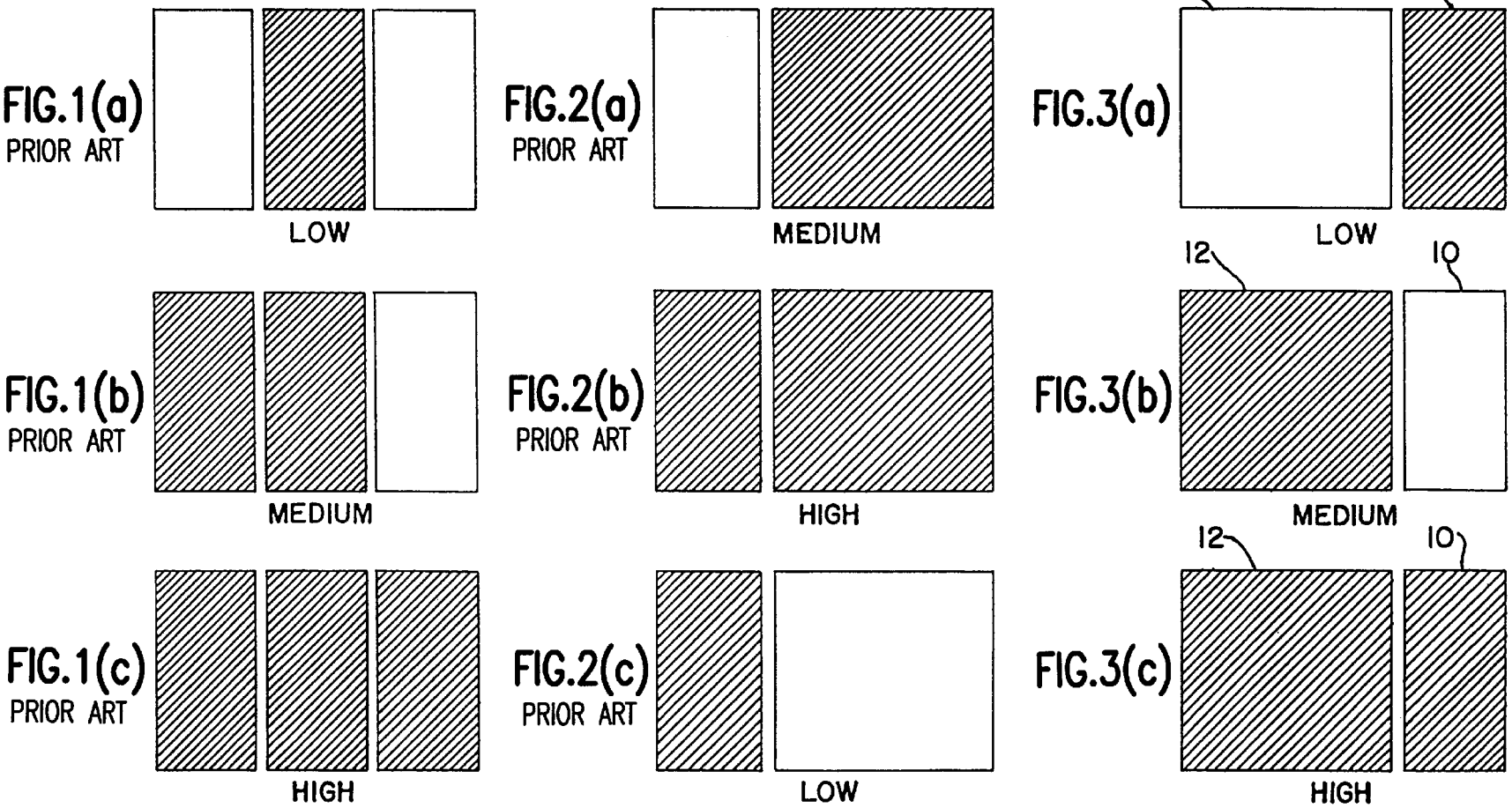
FIG.2(a) PRIOR ART
FIG.2(b) PRIOR ART
FIG.2(c) PRIOR ART
FIG.1(a) PRIOR ART
FIG.1(b) PRIOR ART
FIG.1(c) PRIOR ART
FIGS. 1(*a*)–1(*c*) are schematic drawings showing the operating sequence of a prior art three-plaque burner.
FIGS. 2(*a*)–2(*c*) are schematic drawings showing the operating sequence of a prior art two-plaque burner.
FIGS. 3(*a*)–3(*c*) are schematic drawings showing the operating sequence of a two-plaque burner embodying the present invention.
Figure 4:
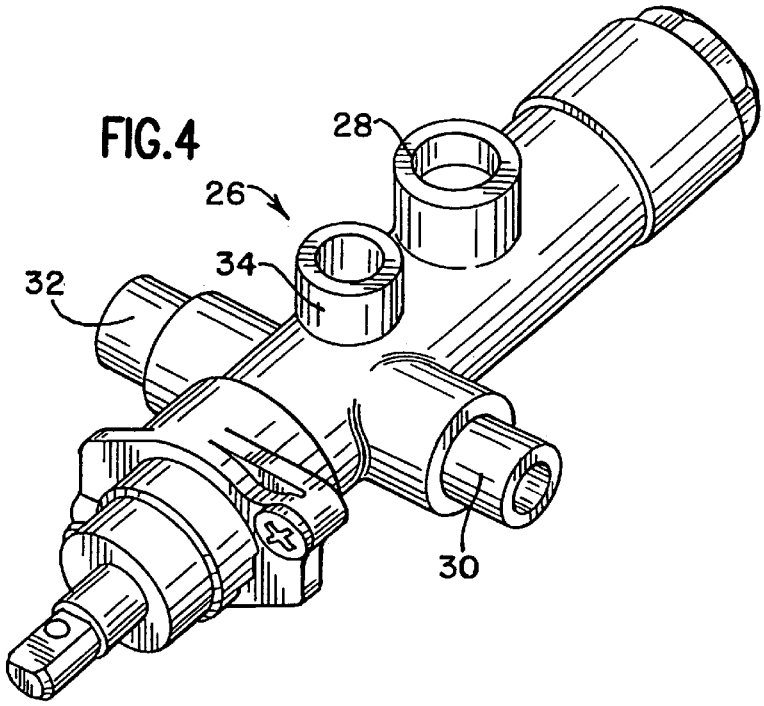
FIG. 4 is an isometric view of a valve in accordance with the present invention.
Figure 5:
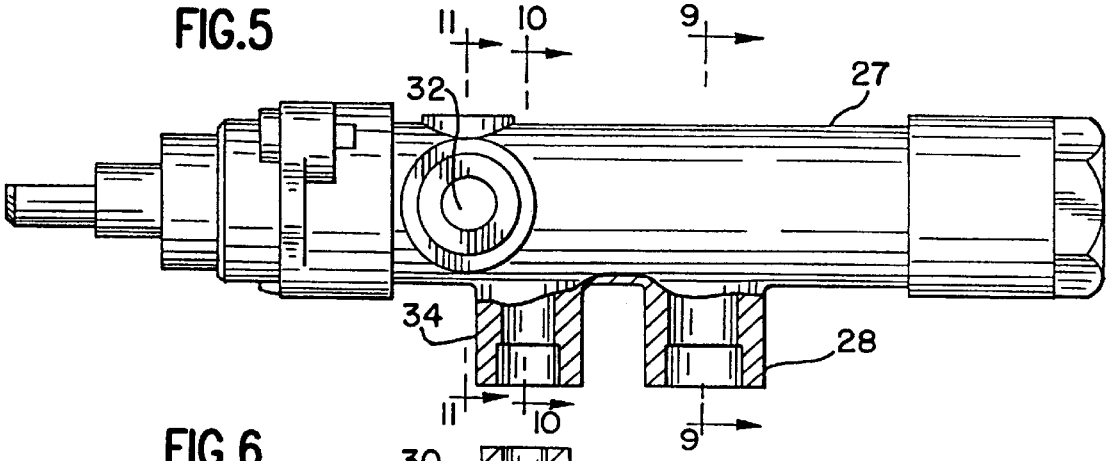
FIG. 5 is a side view of the valve of FIG. 4 with its longitudinal axis in a horizontal plane and with the valve rotated 180° from the position shown in FIG. 4.
Figure 6:
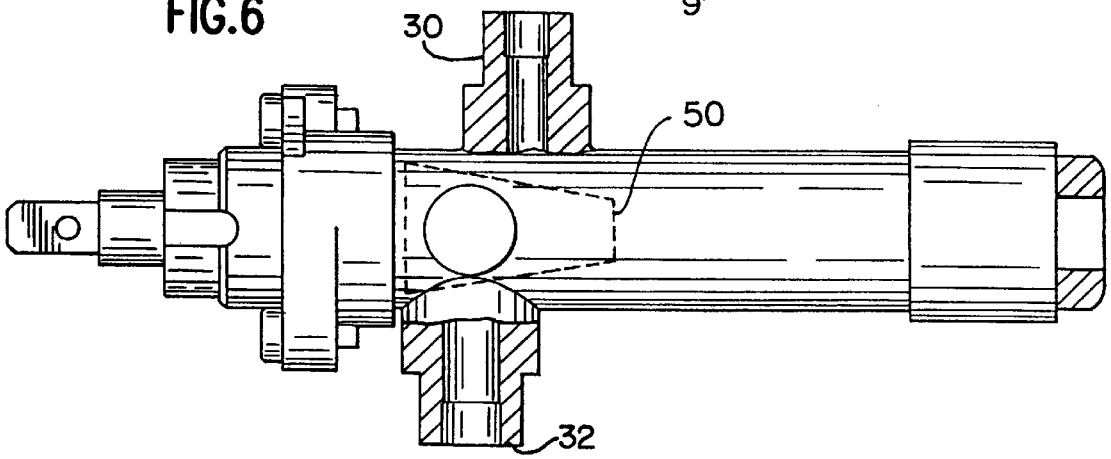
FIG. 6 is a top plan view of the valve as shown in FIG. 5.
Figure 7:
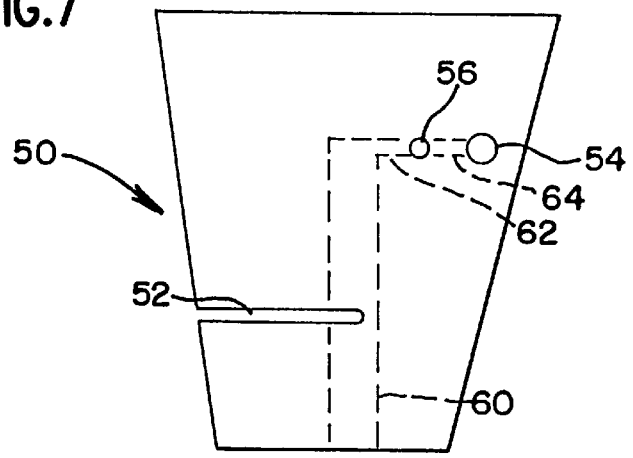
FIG. 7 is a diagramatic view of the spindle of the valve.

The valve housing 27 mounts a frustoconical valve spindle designated 50 in FIG. 7. FIG. 7 illustrates a two-dimensional view of the valve spindle. The valve spindle 50 includes an arcuate slot 52 formed in the exterior surface of the spindle. This arcuate slot is contained in a plane perpendicular to the longitudinal central axis of the valve 26, i.e., the axis of rotation of the valve spindle 50. The slot 52 extends through an arc of approximately 180°.

The valve spindle also includes a radial bore 54 which opens to the exterior surface of the valve spindle. The valve spindle further includes a second radial bore 56 opening to the exterior surface of the valve spindle. It will be understood that the bores 54 and 56 are co-planar and are contained in a plane which is perpendicular to the axis of rotation of the valve spindle 50. As noted in FIG. 7, the diameter of the bore 54 is larger than the diameter of the bore 56.

The valve spindle 50 includes a first internal, central, axial passageway 60 which communicates the inlet passageway 28 with the arcuate slot 52. The spindle 50 further includes internal passageways 62 and 64 communicating the inlet passageway 28 with the bores 54 and 56. In actual practice, the passageways 60, 62 and 64 are coaxial with each other and with the longitudinal central axis of the valve spindle.

The spindle 50 includes an extension 74 (FIG. 8) which extends exteriorly of the valve housing 27. This extension is connected to a rod and operating knob (not, shown) for rotating the valve spindle in sequence between "Off", "Pilot", "Low", "Medium" and "High" positions. When the valve spindle is in the "Off" position, the spindle passageway 60 is in communication with the valve housing passageway 28, which passageway extends to the source of gas. Passageway 60 in the spindle remains in communication with the passageway 28 through all of the positions of the valve spindle.

The arcuate slot 52 in the valve spindle is arranged for communication with outlet passageways 30 and 34. The bores 54 and 56 in the valve spindle are arranged for communication with the outlet passageway 32.

The operation of the valve can be best understood with reference to FIGS. 9(*a*)–9(*f*), 10(*a*)–10(*f*) and 11(*a*)–11(*f*).

Referring to FIGS. 9(*a*), 10(*a*) and 11(*a*), the valve spindle 50 is shown in the "Off" position; gas is admitted to the arcuate slot 52 and to the bores through the valve housing passageway 28 and spindle passageways 60, 62 and 64. There is no flow to the pilot light assembly 24 or to the burners 10 and 12. Neither the slot 52 nor the bores 54 and 56 communicate with the outlet passageways 30, 32 and 34.

Referring to FIGS. 9(*b*), 10(*b*) and 11(*b*), the valve spindle is shown in its "Pilot" position. In this position, the arcuate slot 52 is brought into communication with the passageway 30 which extends to the pilot light assembly. Thus the pilot light may be ignited by a suitable igniter (not shown). There is no flow to either of the burners because neither the slot 52 nor the bores 54, 56 communicate with the outlet passageways 32 and 34.

FIGS. 9(*c*), 10(*c*) and 11(*c*) show the valve spindle in its "Low" position. In this position, the bore 54 is brought into communication with the outlet passageway 32 thus permitting the flow of gas to the smaller burner 10. In the "Low" position, there is no flow to the large burner 12 because the arcuate slot 52 is not in communication with the valve housing passageway 34.

FIGS. 9(*d*), 10(*d*) and 11(*d*) show the valve spindle 50 in an intermediate position between its "Low" and "Medium" positions. Looking to FIG. 10(*d*), we see that the arcuate slot 52 has been brought into communication with the valve housing passageway 34 thus permitting the flow of gas to the larger burner 12. As seen in FIG. 11(*d*), gas continues to flow from the bore 54 to the passageway 32 extending to the smaller burner 10. This feature, resulting from the larger diameter bore 54, ensures that the gas being admitted to the larger burner plaques 16 and 18 will be ignited by flame on the front surface of the plaque 14 of the smaller burner.

Referring now to FIGS. 9(*e*), 10(*e*) and 11(*e*), the spindle 50 has been rotated to the "Medium" position. The slot 52 remains in communication with the valve housing passageway 34, thus continuing the flow of gas to the larger burner 12. However, there is no longer a flow to the small burner 10 because the bore 54 is no longer in communication with the valve housing passageway 32.

FIGS. 9(*f*), 10(*f*) and 11(*f*) illustrate the valve spindle in its "High" position. The arcuate slot 52 remains in communication with the valve housing passageway 34 for continuing the flow of gas to the larger burner 12. The smaller-in-diameter bore 56 is brought into communication with the valve housing passageway 32 for admitting gas to the smaller burner 10. Smaller burner 10 will be ignited both by the pilot flame and the flame adjacent the face of the larger burner 12.

Accordingly, it is seen that the present invention provides an apparatus and method for utilizing two burners of different sizes and for igniting such burners to provide, in sequence, "Low", "Medium" and "High" heat settings. It will be understood that the foregoing description relates to a preferred embodiment of the invention by way of example only.

Many variations of the invention will be apparent to those skilled in the art and such variations are within the scope of the invention as set forth in the following claims.

We claim:

1. The method of controlling ignition of a first plaque burner and a larger second plaque burner mounted in substantial coplanar adjoining relationship with the first plaque burner to achieve "Low", "Medium" and "High" heat settings in series, comprising the steps of:

(a) supplying a pilot flame in the vicinity of the first plaque burner;

(b) supplying gas to the vicinity of the first plaque burner and igniting the gas by the pilot flame to establish a "Low" heat setting by gas burning in the vicinity of the first plaque burner;

(c) supplying gas in the vicinity of the second plaque burner while maintaining gas flow to the first plaque burner thereby to ignite the gas in the vicinity of the second plaque burner at least in part by the gas burning in the vicinity of the first gas burner;

(d) disconnecting the flow of gas to the first plaque burner while maintaining the flow of gas to the second plaque burner to establish a "Medium" heat setting by gas burning in the vicinity of the second plaque burner; and (e) reestablishing the flow of gas to the first plaque burner while maintaining the flow of gas to the second plaque burner for igniting gas in the vicinity of the first plaque burner to establish a "High" heat setting by gas burning in the vicinities of both the first and second plaque burners.

2. A method as claimed in claim 1 including the steps of:

providing a valve having one inlet and first, second and third outlets;

providing a pilot light assembly;

connecting a first tube between said pilot light assembly and said first outlet;

connecting a second tube from said second outlet to the vicinity of said first plaque burner; and connecting a third tube from said third outlet to the vicinity of said second plaque burner.

3. A method for operating a ceramic gas burner having a small plaque burner and a large plaque burner whereby a user can sequence from "Off" to "Low", "Medium" and "High" heat settings comprising the steps of:

providing a valve with one gas inlet and three gas outlets, a first outlet being connected to a pilot, a second outlet for directing gas to said small plaque burner and a third outlet for directing gas to said large plaque burner;

maintaining said inlet in an open mode;

blocking said first, second and third outlets for placing said ceramic gas burner in its "Off" mode;

then blocking said second and third outlets and having said first outlet in an open condition for placing said ceramic burner in a pilot "On" mode and both of said plaque burners are in an "Off" mode;

then blocking said third outlet and having said first and second outlets in an open condition for placing said ceramic burner in a pilot and small plaque burner "On" mode and said second plaque burner in an "Off" mode for achieving a "Low" heat setting;

then opening all of said outlets for a short time span when said ceramic burner is cycled between "Low" and "Medium" heat settings;

then blocking said second outlet and having said first and third outlets in an open condition for placing said ceramic burner in a pilot and large plaque burner "On" mode and said first plaque burner in an "Off" mode for achieving a "Medium" heat setting; and then opening all of said outlets for achieving a "High" heat setting.

4. A method as claimed in claim 3 wherein:

said valve is elongated and said inlet, said first outlet, and said second outlet are each located in different transverse planes.

5. A method as claimed in claim 4 wherein:

said first and third outlets are located in the same transverse plane.

6. a method as claimed in claim 3 including the step of:

providing a valve having an elongated housing and a spindle and placing said inlet, said first outlet and said second outlet in different transverse planes.

7. A method as claimed in claim 6 including the step of:

placing said first and third outlets in the same transverse plane.

8. A method for making a ceramic gas burner having a small plaque burner and a large plaque burner in adjacent relationship comprising the steps of:

providing a small plaque burner;

providing a large plaque burner;

providing a pilot light assembly;

providing a single valve having one gas inlet and first, second and third gas outlets;

connecting a first tube between said first outlet and said pilot light assembly;

connecting a second tube between said second outlet and a vicinity of said small plaque burner; and connecting a third tube between said third outlet and a vicinity of said large plaque burner.

9. A method as claimed in claim 8 including the step of:

providing a fourth tube for connecting said inlet to a source of gas.

10. A method as claimed in claim 9 wherein:

said valve is elongated and said inlet, said first outlet and said second outlet are each located in different transverse planes.

11. A method as claimed in claim 10 wherein:

said first and third outlets are located in the same transverse plane.

12. A method as claimed in claim 8 including the step of:

providing a valve having an elongated housing and a spindle and placing said inlet, said first outlet and said second outlet in different transverse planes.

13. A method as claimed in claim 12 including the step of:

placing said first and third outlets in the same transverse plane.

* * * * *